US006497468B1

(12) United States Patent
Otsuka

(10) Patent No.: US 6,497,468 B1
(45) Date of Patent: Dec. 24, 2002

(54) PRINTING APPARATUS, AND METHOD FOR CONTROLLING THE POWER OF THE PRINTING APPARATUS

(75) Inventor: Naoji Otsuka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/610,377

(22) Filed: Jul. 5, 2000

(30) Foreign Application Priority Data

Jul. 6, 1999 (JP) ..... 11-191869

(51) Int. Cl.[7] ..... B41J 29/38
(52) U.S. Cl. ..... 347/16
(58) Field of Search ..... 347/5, 14, 16, 347/17; 346/134; 400/578

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,608,577 A | | 8/1986 | Hori | 347/66 |
| 4,723,129 A | | 2/1988 | Endo et al. | 347/56 |
| 4,740,796 A | | 4/1988 | Endo et al. | 347/56 |
| 5,349,905 A | | 9/1994 | Taylor et al. | 101/488 |
| 5,486,910 A | * | 1/1996 | Harada | 355/309 |
| 6,209,984 B1 | * | 4/2001 | Kim | 347/37 |

FOREIGN PATENT DOCUMENTS

| | | | |
|---|---|---|---|
| JP | 54-56847 | 5/1979 | |
| JP | 59-123670 | 7/1984 | |
| JP | 59-138461 | 8/1984 | |
| JP | 60-71260 | 4/1985 | |
| JP | 3-79372 | 4/1991 | B41J/25/312 |

* cited by examiner

*Primary Examiner*—John Barlow
*Assistant Examiner*—Blaise Mouttet
(74) *Attorney, Agent, or Firm*—Fitzpatrick, Cella, Harper & Scinto

(57) ABSTRACT

A printing apparatus for performing printing on a printing medium using a print head includes an electrical-power-distribution determination unit for determining a state of concurrence of respective control units for a sheet feeding mechanism, a sheet conveying mechanism, a carriage mechanism and the like and supplying optimum electric power at that time, even if a dedicated motor is provided for each of the mechanisms. For example, when the carriage mechanism is operating and the sheet conveying mechanism is performing driving, low-speed sheet feeding is performed. When neither the carriage mechanism nor the sheet conveying mechanism are performing driving, high-speed sheet feeding is performed. By thus optimizing distribution of electric power for a plurality of driving sources of the printing apparatus, high-speed recording with low electrical power can be realized.

27 Claims, 7 Drawing Sheets

PRINTING APPARATUS, AND METHOD FOR CONTROLLING THE POWER OF THE PRINTING APPARATUS

BACKGROUND OF THE INVENTION

1. Field of the Invention

The present invention relates to a printing apparatus.

2. Description of the Related Art

Conventionally, in a printing apparatus having a sheet feeding mechanism, a sheet conveying mechanism, a carriage mechanism and the like, in order to provide a high printing speed and simplify the mechanisms, a dedicated motor or the like is provided for driving each of the mechanisms and operating each of the mechanisms at an optimum timing.

In the above-described conventional approach, however, the number of motors which are simultaneously driven increases, thereby increasing, for example, the peak electric power, the size of the power supply and the size of the apparatus. That is, in order to achieve high-speed printing, a method has been adopted in which feeding of a succeeding sheet of a recording medium is started before discharging a preceding sheet of the recording medium, using a plurality of motors. In this method, since a sheet feeding operation and a sheet discharging operation are performed in a state of being partially overlapped, the total throughput can be shortened. However, this method results in a large increase in the used electric power, so that the capacity of the power supply must be designed so as to coincide with the maximum electric power, thereby increasing, for example, the size of the power supply and the size of the apparatus, as described above.

SUMMARY OF THE INVENTION

The present invention has been made in consideration of the above-described problems.

It is an object of the present invention to provide a printing apparatus which can perform high-speed recording with lower electric power by optimizing the distribution of electric power for a plurality of driving sources.

According to one aspect, the present invention which achieves the above-described object relates to a printing apparatus for performing printing on a printing medium using a print head. The printing apparatus includes printing medium feeding means, driven by electric power, for feeding the printing medium in a direction toward the print head before performing printing, electric-power control means for controlling electric power for driving the printing medium feeding means, at least one electric-power using source other than the printing-medium feeding means, and determination means for determining a state of use of electric power of the at least one electric-power using source, when driving the printing medium feeding means. The electric-power control means controls electric power for driving the printing-medium feeding means, based on a result of determination of the determination means.

According to another aspect, the present invention which achieves the above-described object relates to a method for controlling electric power in a printing apparatus for performing printing on a printing medium using a print head. The method includes a printing medium feeding step, utilizing a printing medium feeding unit driven by electric power, for feeding the printing medium in a direction toward the print head before performing printing, and a determination step for determining a state of use of electric power by components other than the printing medium feeding unit, when executing the printing medium feeding step, the other components being executable simultaneously with the printing-medium feeding step. A magnitude of electric power used by the printing medium feeding unit in the printing-medium feeding step is controlled in accordance with a result of the determination in the determination step.

According to yet another aspect of the present invention, a printing apparatus for performing printing on a printing medium using a print head includes a printing medium feeding unit, at least one electric-power using source other than the printing medium feeding unit, and a controller. The printing medium feeding unit feeds the printing medium in a direction toward the print head before performing printing, and is driven by electric power. The controller controls the electric power for driving the printing medium feeding unit and the at least one electric-power using source. The controller determines a state of use of electric power of the at least one electric-power using source, when driving the printing medium feeding unit. The controller controls electric power for driving the printing medium feeding unit, based on a result of determination regarding the state of use of electric power.

In this specification, the word "printing" indicates not only a case of forming significant information comprising characters, drawings and the like, but also a case of forming information comprising images, figures, patterns and the like on a printing medium, or processing the printing medium, whether or not the information is significant or insignificant, and whether or not the information is visualized so as to be sensed by the human being.

The terms "printing medium" indicates not only paper used in an ordinary printing apparatus, but also a substance which can receive ink, such as a cloth, a plastic film, a metal plate or the like.

The word "ink" is to be as widely construed as the above-described definition of "printing", and indicates a substance which can be used for forming images, figures, patterns and the like on a printing medium, or processing of the printing medium by being provided onto the printing medium.

DETAILED DESCRIPTION OF THE PREFERRED EMBODIMENT

Figure 1:
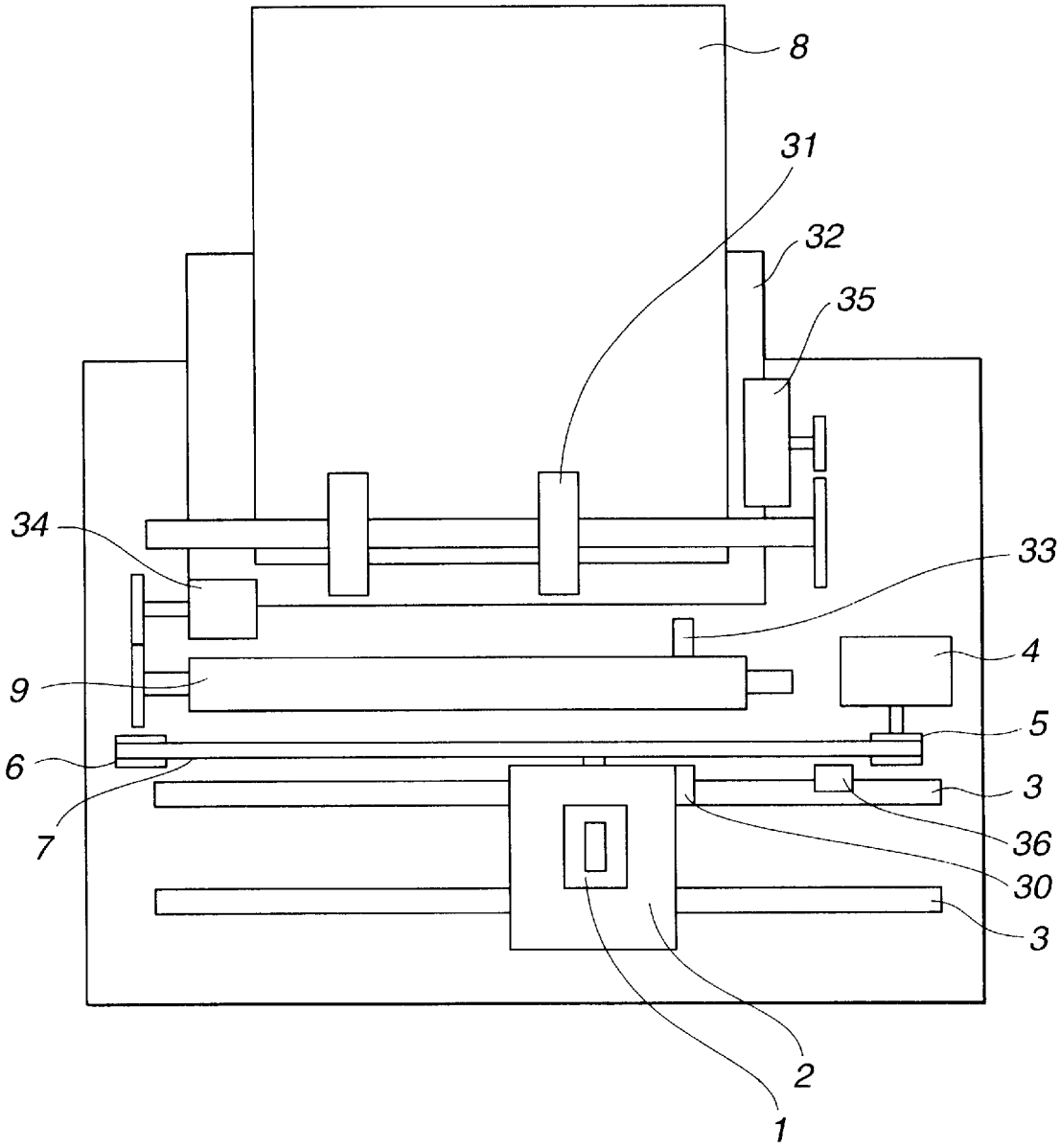
FIG. 1 is a schematic diagram illustrating the configuration of an ink-jet printing apparatus according to an embodiment of the present invention.

A printing apparatus having a high-speed printing mechanism according to a preferred embodiment of the present invention has the feature of having an electric-power control mechanism operating when performing a sheet feeding operation. The effects of this embodiment are achieved by determining usable surplus electric power in a process portion where electric power consumed by a sheet feeding mechanism, electric power consumed by a sub-scanning mechanism, electric power consumed by a main scanning mechanism, and electric power consumed by a printing mechanism are overlapped, and driving the sheet feeding mechanism with electric power within a usable range. The feature of the embodiment is that in determination of a driving method at that time, control can be performed so as to minimize the total printing time.

When intending to increase the throughput of the printing apparatus, this object can be most efficiently achieved by shortening a sheet feeding time and a sheet discharging time. For example, in the case of a printing speed of 10 ppm (pages per minute), the average printing time for one page is 6 seconds. If the sheet discharging time is 3 seconds per sheet, the time used for printing is only 3 seconds.

Sheet feeding and sheet discharging are performed according to the following three approaches.

(1) Sheet feeding for printing the first sheet of a printing medium.

(2) Feeding of the succeeding sheet is started during an operation of discharging the preceding sheet after completing printing on the preceding sheet.

(3) Feeding of the succeeding sheet is started while the preceding sheet is printed.

In case (1), a net sheet feeding time is required. Basically, a carriage mechanism for moving a print head need not move, and the print head does not perform printing. Accordingly, little electric power is consumed. A movement having the highest priority in this case is sheet feeding at the highest speed from an automatic sheet feeder (ASF) for feeding a sheet of the printing medium toward the print head before performing printing. Accordingly, a driving motor can consume electric power for rotating a sheet feeding roller of the ASF at the highest speed.

In case (2), while performing driving in a sub-scanning direction in order to discharge the preceding sheet, driving of the succeeding sheet is started at an optimum position in consideration of the current position of the preceding sheet. Also in this case, basically, the carriage mechanism need not move, and the print head does not perform printing. Only driving for sub-scanning for sheet discharge is performed. Accordingly, electric power is not greatly consumed. Movements having the highest priority in this case are prompt completion of a sheet discharging operation and completion of sheet feeding at the timing of completion of sheet discharge. Accordingly, the driving motor can consume electric power for rotating sheet discharging rollers at the highest speed. Sheet feeding is achieved by starting driving of the sheet feeding, roller of the ASF at a rotational speed that does not cause the maximum peak electric power, and ending the driving at the timing of completion of discharge of the preceding sheet.

In case (3), driving for feeding the succeeding sheet is started at an optimum time in consideration of the current position of the preceding sheet. In this case, since printing of the preceding sheet is continued, the carriage mechanism must move, and the print head must perform printing. Two cases are present in which simultaneous driving is performed. In one case, driving for main scanning of a carriage and driving for sub-scanning are simultaneously performed (at the timing in which a ramp up/down operation of the carriage and a sheet feeding operation are overlapped). In another case, main scanning for moving the carriage and driving of the print head for printing are simultaneously performed (a case in which ink is actually discharged by driving the print head while the carriage moves at a constant speed). In each of these cases, three driving operations including the above-described driving operations and driving for sheet feeding are simultaneously performed. Accordingly, a great amount of electric power is consumed if the three driving operations are performed without reducing electric power. A movement having the highest priority in these cases is continuation of printing without reducing the speed. Accordingly, by providing highest priority to driving for main scanning of the carriage, driving for sub-scanning and driving for the print head, and driving the sheet feeding roller of the ASF at minimum electric power by starting the driving at a rotational speed that does not cause the maximum peak electric power, and completing sheet feeding at the timing of completion of discharge of the preceding sheet, the object of the embodiment is achieved.

In another approach, by determining a time required for the next operation of other mechanisms within the sheet feeding time when performing a sheet feeding operation, and determining the most advantageous combination by providing priority orders, it is possible to provide a printing apparatus which can achieve a higher speed of the total throughput. More specifically, during the sheet feeding operation for printing the first sheet in the above-described case (1), for example, an operation for opening a cap protecting a nozzle portion of a head cartridge, or a preliminary discharging operation for maintenance of the print head, although printing is not performed, may be performed, or the carriage may be horizontally moved at a precise timing. In these cases, it is also possible to determine whether a sheet feeding operation is to be performed after completing the above-described operation, or driving is to be performed by limiting electric power during the above-described operation.

The preferred embodiment will now be described in detail with reference to the drawings. In the drawings, the same components are indicated by the same reference numerals.

FIG. 1 is a diagram illustrating the configuration of a principal portion of an ink-jet printing apparatus according to the embodiment.

In FIG. 1, a head cartridge 1 is exchangeably mounted in a carriage 2. The head cartridge 1 includes a print-head unit, an ink-tank unit, and a connector (not shown) for transmitting, for example, a signal for driving the print-head unit.

The head cartridge 1 is exchangeably mounted in the carriage 2 by being positioned therein. The carriage 2 includes a connector holder (electrical connection unit) for transmitting, for example, the driving signal to the head cartridge 1 via the connector.

The carriage 2 is guided and supported by guide shafts 3, provided in the main body of the apparatus and extending in the main scanning direction, so as to be reciprocatable. The carriage 2 is driven by a main-scanning motor 4 via a driving mechanism comprising a motor drive pulley 5, a driven pulley 6, a timing belt 7 and the like, and the position and the movement of the carriage 2 are controlled. A home-position sensor 30 is provided on the carriage 2. It is possible to know the position of the carriage 2 when the home-position sensor 30 on the carriage 2 passes through the position of a shielding plate 36.

Sheets of a printing medium 8, such as printing paper, plastic thin films or the like, are individually separated and fed from an automatic sheet feeder (ASF) 32 by rotating pickup rollers 31 by a sheet feeding motor 35 via a gear. A separated and fed sheet is further conveyed (sub-scanned) passing through a position (a printing portion) facing a discharging-port surface of the head cartridge 1, by the rotation of a conveying roller 9. The conveying roller 9 is driven by the revolution of an LF (line feeding) or sub-scanning motor 34 for intermittently conveying the sheet in a sub-scanning direction every time one line has been recorded, via a gear. At that time, determination whether or not sheet feeding has been performed, and confirmation of a leading position during sheet feeding are performed when the sheet passes through a sheet-end sensor 33. The sheet-end sensor 33 is also used for confirming the actual position of the trailing edge of the sheet and finally estimating the current recording position from the actual position of the trailing edge. The reverse side of the printing medium 8 is supported by a platen (not shown) in order to form a flat printing surface at the printing portion. In this case, the head cartridge 1 mounted on the carriage 2 is supported so that the discharging-port surface of the head cartridge 1 is parallel to the printing medium 8 over the length of the conveying roller 9 in a state of protruding downward. The head cartridge 1 is an ink-jet head cartridge for discharging ink utilizing thermal energy, and includes electrothermal transducers for generating the thermal energy. That is, the print head of the head cartridge 1 performs printing by discharging ink from discharging ports, utilizing the pressure of bubbles generated by film boiling caused by thermal energy applied by the electrothermal transducers.

Figure 2:
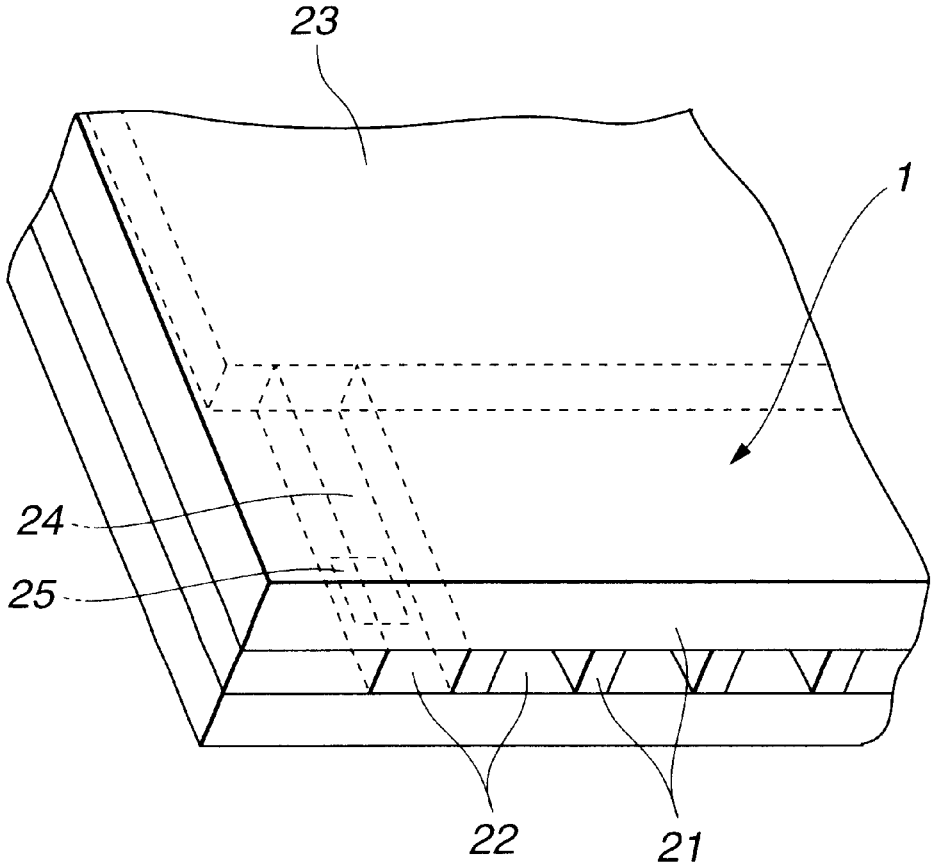
FIG. 2 is a partially transparent schematic perspective view illustrating the configuration of a principal portion of a print head.

FIG. 2 is a partially transparent schematic perspective view illustrating the configuration of a main portion of the print-head unit of the head cartridge 1.

In FIG. 2, a plurality of discharging ports 22 are formed with a predetermined pitch on a discharging-port surface 21 facing the printing medium 8 with a predetermined gap (for example, about 0.5–2.0 mm), and an electrothermal transducer (for example, a heating resistor) 25 for generating thermal energy utilized for ink discharge is disposed on a wall of each liquid channel 24 communicating with a common liquid chamber 23 and a corresponding one of the discharging ports 22. In this embodiment, the head cartridge 1 is mounted on the carriage 2 with a positional relationship such that the discharging ports 22 are arranged in a direction crossing the scanning direction of the carriage 2. Thus, a print head for causing film boiling of ink within the liquid channel 24 by driving (supplying current to) the corresponding electrothermal transducer 25 (hereinafter also termed a "discharge heater") based on an image signal or a discharge signal, and discharging the ink from the discharging port 22 by the pressure generated at that time is provided.

Figure 3:
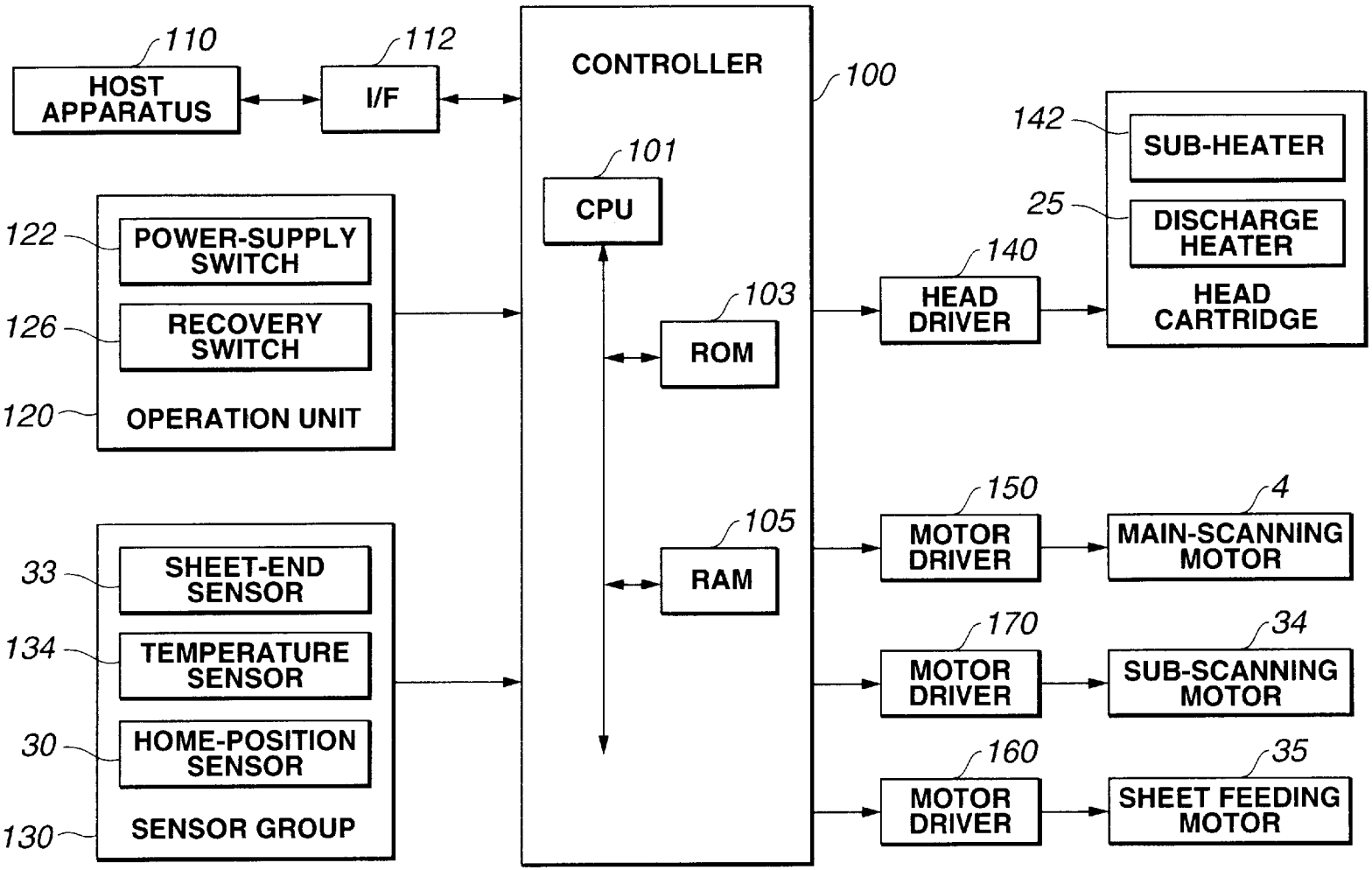
FIG. 3 is a schematic block diagram illustrating the configuration of a control circuit in .the ink-jet printing apparatus shown in FIG. 1.

FIG. 3 is a schematic block diagram illustrating the configuration of a control circuit in the above-described ink jet recording apparatus.

In FIG. 3, a controller 100, serving as a main control unit includes, for example, a CPU (central processing unit) 101, such as a microprocessor or the like, a ROM (read-only memory) 103 storing programs, necessary tables and other fixed data, and a RAM (random access memory) 105 including, for example, regions for developing image data, and operating regions. A host apparatus 110 serves as a supply source of image data (may, for example, be a computer for forming and processing data of images to be printed, or a reader unit for reading images). Image data, other commands, status signals and the like are transmitted to/received from the controller 100 via an interface (I/F) 112.

An operation unit 120 includes switches for inputting instructions by the operator, such as a power-supply switch 122, and a recovery switch 126 for instructing start of suction recovery or the like.

A sensor group 130 includes sensors for detecting states of the apparatus, and includes, for example, the home-position sensor 30, the sheet-end sensor 33 for detecting presence of the printing medium, and a temperature sensor 134 provided at an appropriate position in order to detect ambient temperature.

A head driver 140 drives the discharging heaters 25 of the head cartridge 1 in accordance with printing data and the like. The head driver 140 includes, for example, a shift register for arranging printing data so as to correspond to the positions of the discharge heaters 25, a latch circuit for latching data at an appropriate timing, a logic circuit element for operating a corresponding discharging heater in synchronization with a driving timing signal, and a timing setting unit for appropriately setting a driving timing (discharging timing) in order to adjust a dot forming position.

The head cartridge 1 includes a sub-heater 142. The sub-heater 142 performs temperature adjustment for stabilizing the discharging property of ink, and may be formed on the substrate of the print head simultaneously with the formation of the discharge heaters 25, and/or mounted on the main body of the print head or on the head cartridge.

A motor driver 150 drives the main-scanning motor 4, a motor driver 170 drives the sub-scanning motor 34, and a motor driver 160 drives the sheet feeding motor 35. Electric-power using sources other than the printing-medium feeding unit in the present invention include the above-described print head, carriage and LF motor.

A description will now be provided of control for a sheet feeding operation from each state.

Figure 4:
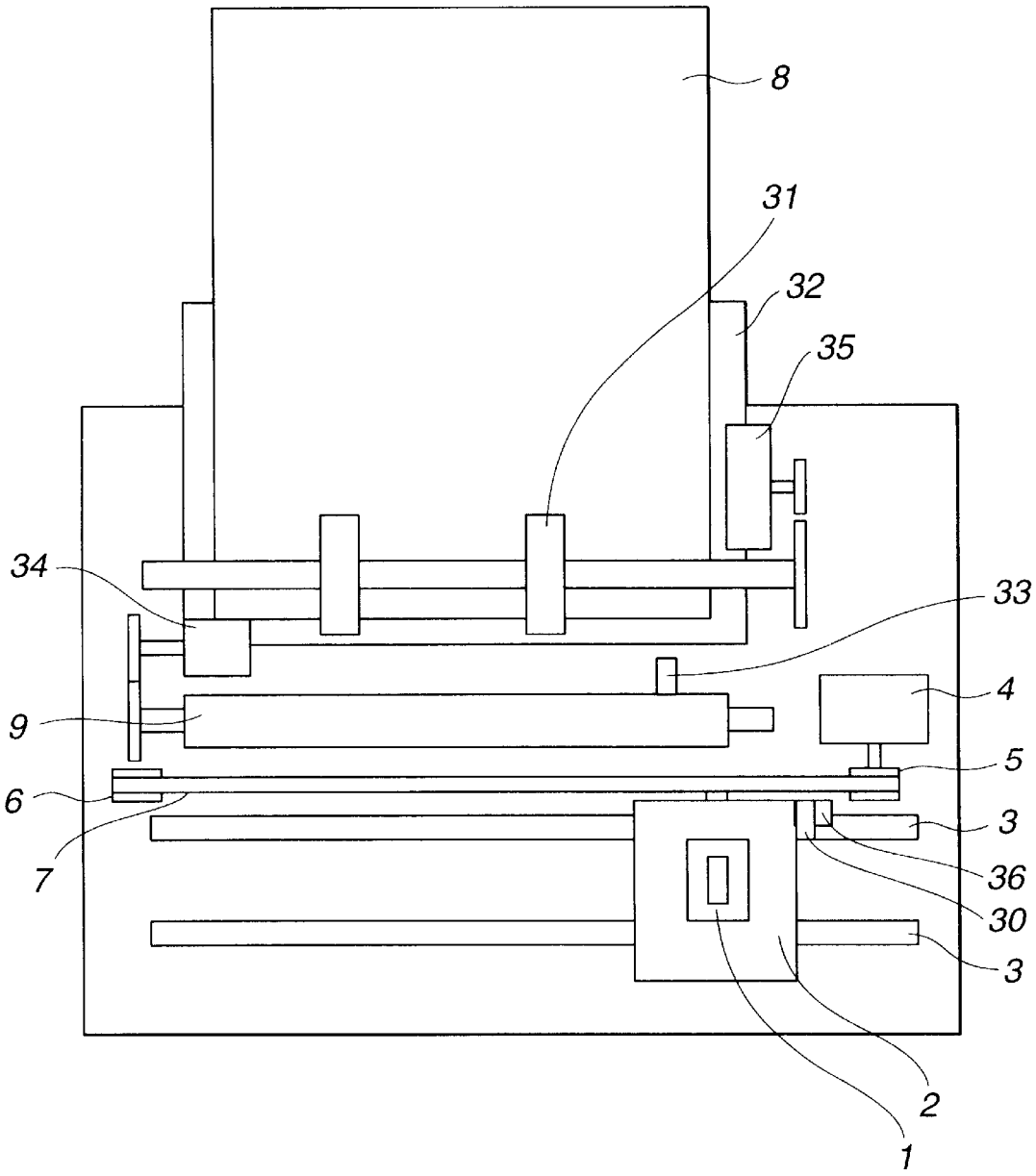
FIG. 4 is a diagram illustrating a state immediately before starting sheet feeding.
Figure 5:
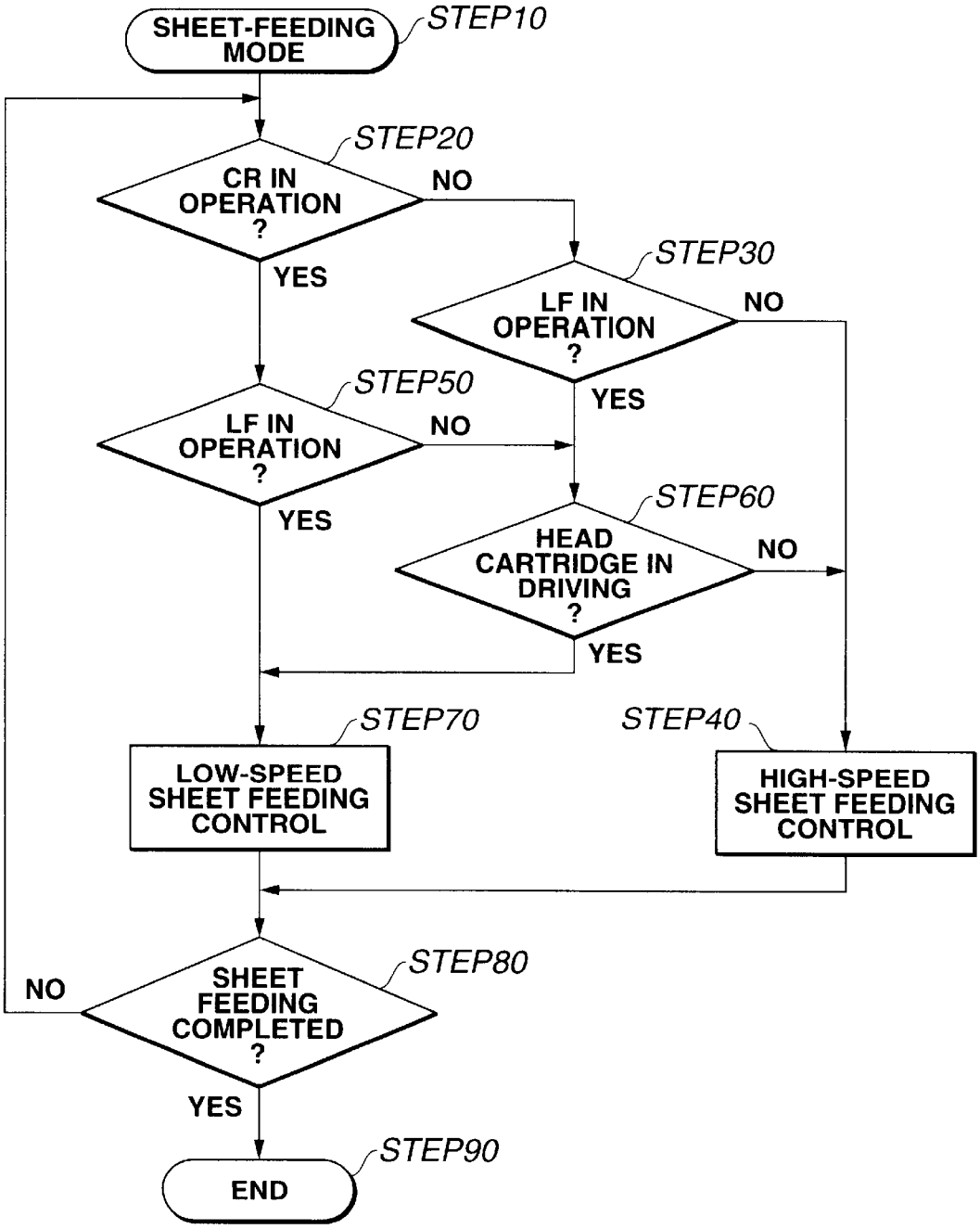
FIG. 5 is a flowchart illustrating the, flow of control in the embodiment.

FIG. 4 is a diagram illustrating the above-described case (1). In this state, sheets of the printing medium 8 are stored in the ASF 32. Since there is no preceding sheet, a first printing operation is performed. This operation will be described with reference to the flowchart shown in FIG. 5, which is performed by controller 100. When a printing command has been provided for the printing apparatus, the printing apparatus starts feeding of the printing medium in order to start printing, after or while performing various known initial operations. In the flowchart shown in FIG. 5, a sheet-feeding mode is started in step S10. Then, in step S20, it is determined if the carriage (CR) 2 is operating, for example, as an initial operation. If the result of the determination in step S20 is negative, the process proceeds to step S30.

In step S30, it is determined if an LF operation is being performed for some reason. If the result of the determination in step S30 is negative, the process proceeds to step S40, where high-speed sheet feeding control is started. The process then proceeds to step S80, where it is determined if sheet feeding has been completed. If the result of the determination in step S80 is negative, the process returns to step S20. If the result of the determination in step S80 is affirmative, the process proceeds to step S90, where the sheet-feeding mode is terminated. In this case, it is. determined that highest-speed sheet feeding can be performed without limitation of electric power, and the maximum power is supplied to the sheet feeding motor 35 shown in FIG. 4.

If the result of the determination in step S30 is affirmative, the process proceeds to step S60, where it is determined if the head cartridge 1 is being driven. If the result of the determination in step S60 is negative, the process proceeds to step S40, and the above-described processing after step S40 is performed. In this case, when only LF driving and ASF driving are performed and there is still room for electric power, high-speed sheet feeding can be performed assuming that the state of use of electric power is within a predetermined state of use. Although in this embodiment, only one level is provided for high-speed sheet feeding control, a plurality of levels may be provided in accordance with the state of concurrence. If the result of the determination in step S60 is affirmative, it is assumed that the state of use of electric power exceeds the predetermined state of use, and the process proceeds to step S70 for performing low-speed sheet feeding control. The state of the head cartridge 1 in driving indicates, for example, a state of preliminary discharge in an initial operation. In this case, there is little room for electric power because LF driving, driving of the head cartridge 1 and ASF driving are simultaneously performed. Hence, low-speed sheet feeding control requiring small power consumption per unit time is provided. The process then proceeds to step S80, and the above-described processing after step S80 is performed. The low speed is represented by a first speed, and the high speed is represented by a second speed.

If the result of the determination in step S20 is affirmative, the process proceeds to step S50, where it is determined if LF is operating. If the result of the determination in step S50 is negative, the process proceeds to step S60, where it is determined if the head cartridge 1 is being driven. If the result of the determination in step S60 is affirmative, the process proceeds to step S70. In this case, since the operation of the carriage 2, driving of the head cartridge 1 and a sheet feeding operation of the ASF 32 are simultaneously performed, a low-speed sheet feeding operation is performed due to limitation in electric power.

If the result of the determination in step S50 is affirmative, the process proceeds to step S70, where a low-speed sheet feeding operation is performed.

The sheet feeding operation in this case indicates sheet feeding of the printing medium 8 to a position immediately before the conveying roller 9, because of the following reason. That is, a sheet feeding operation and a sub-scanning LF operation are, in most cases, simultaneously performed instantaneously because the leading edge of the printing medium 8 is caused to enter the conveying roller 9 even after the printing medium 8 has been conveyed to a position immediately before the conveying roller 9. In this case, the sheet feeding motor 35 may be driven until the printing medium 8 is conveyed to a position immediately before the conveying roller 9, and then the sheet feeding operation is switched to low-speed sheet feeding in which the maximum electric power is not provided.

Figure 6:
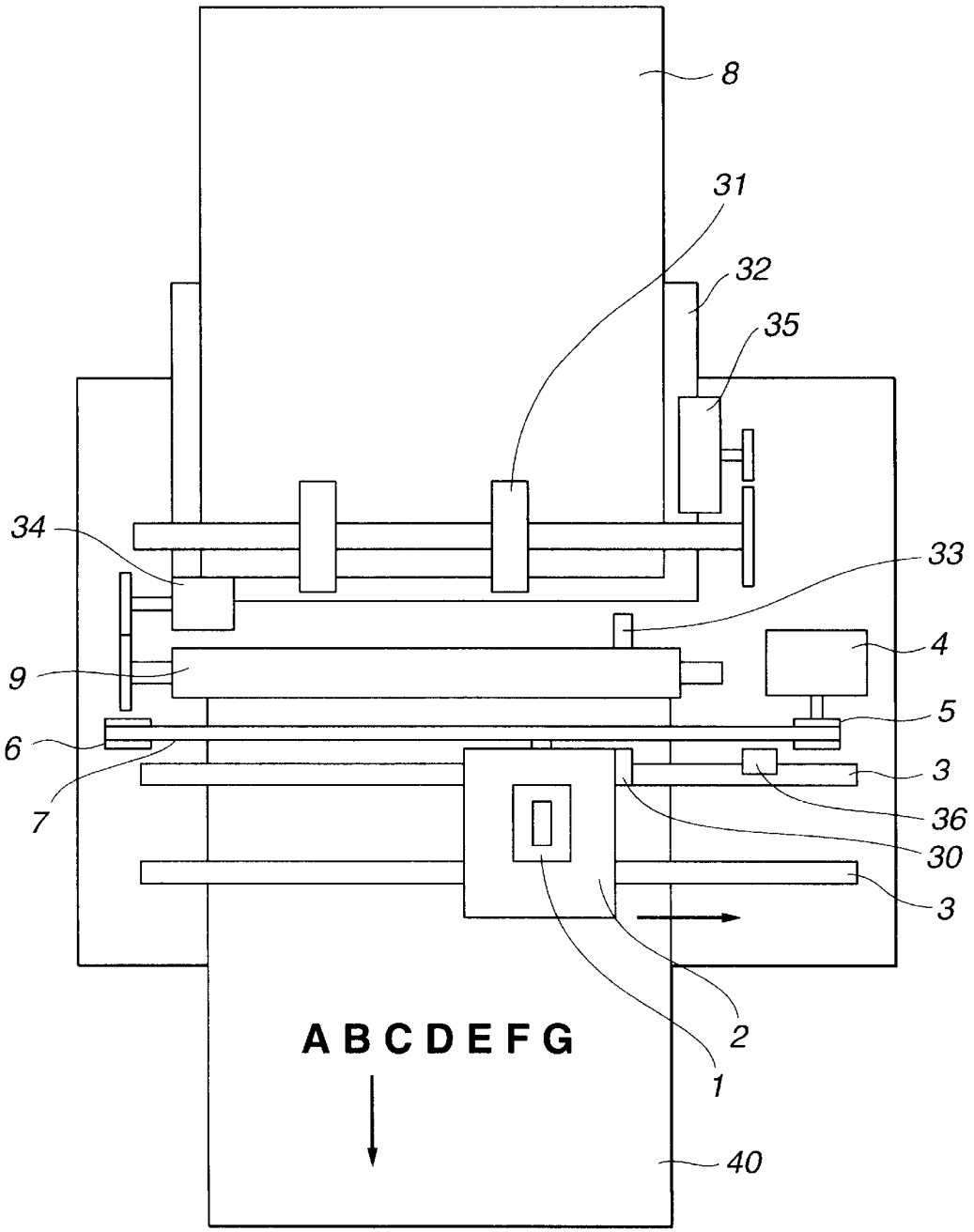
FIG. 6 is a diagram illustrating another state immediately before starting sheet feeding.

A description will now be provided of the above-described case (2), in which feeding of the succeeding sheet is started during an operation of discharging the preceding sheet after completing printing on the preceding sheet. FIG. 6 illustrates such a case.

FIG. 6 illustrates a state immediately before a preceding sheet 40 of the printing medium is discharged from the printing apparatus after completing printing on the sheet 40. A succeeding sheet 8 is stored in the ASF 32. Since printing has been completed on the preceding sheet 40, the succeeding sheet 8 provides a second print. The operation will now be described with reference to the flowchart shown in FIG. 5. When a printing command has been provided for the printing apparatus, feeding of the printing medium is started in order to start printing. In the flowchart shown in FIG. 5, the sheet-feeding mode is started in step S10, as described above. In step S20, it is determined if the carriage is operating. If the result of the determination in step S20 is negative, the process proceeds to step S30, where it is determined if LF is operating. In the case of FIG. 6, since the conveying roller 9 is rotating for discharging the preceding sheet 40, the process proceeds to step S60, where it is determined if the head cartridge 1 is operating for preliminary discharge or the like. If the result of the determination in step S60 is negative, the process proceeds to step S40 for high-speed sheet feeding control.

Also in this case, it is determined that a high-speed sheet feeding operation can be performed without limitation of electric power, and the maximum electric power is supplied to the sheet feeding motor 35. If the result of the determination in step S20 is affirmative, or if the result of the determination in step S60 is affirmative, the process proceeds to step S70, where low-speed sheet feeding control is performed. Upon completion of sheet feeding, the process proceeds to step S90, where the sheet-feeding mode is terminated.

Figure 7:
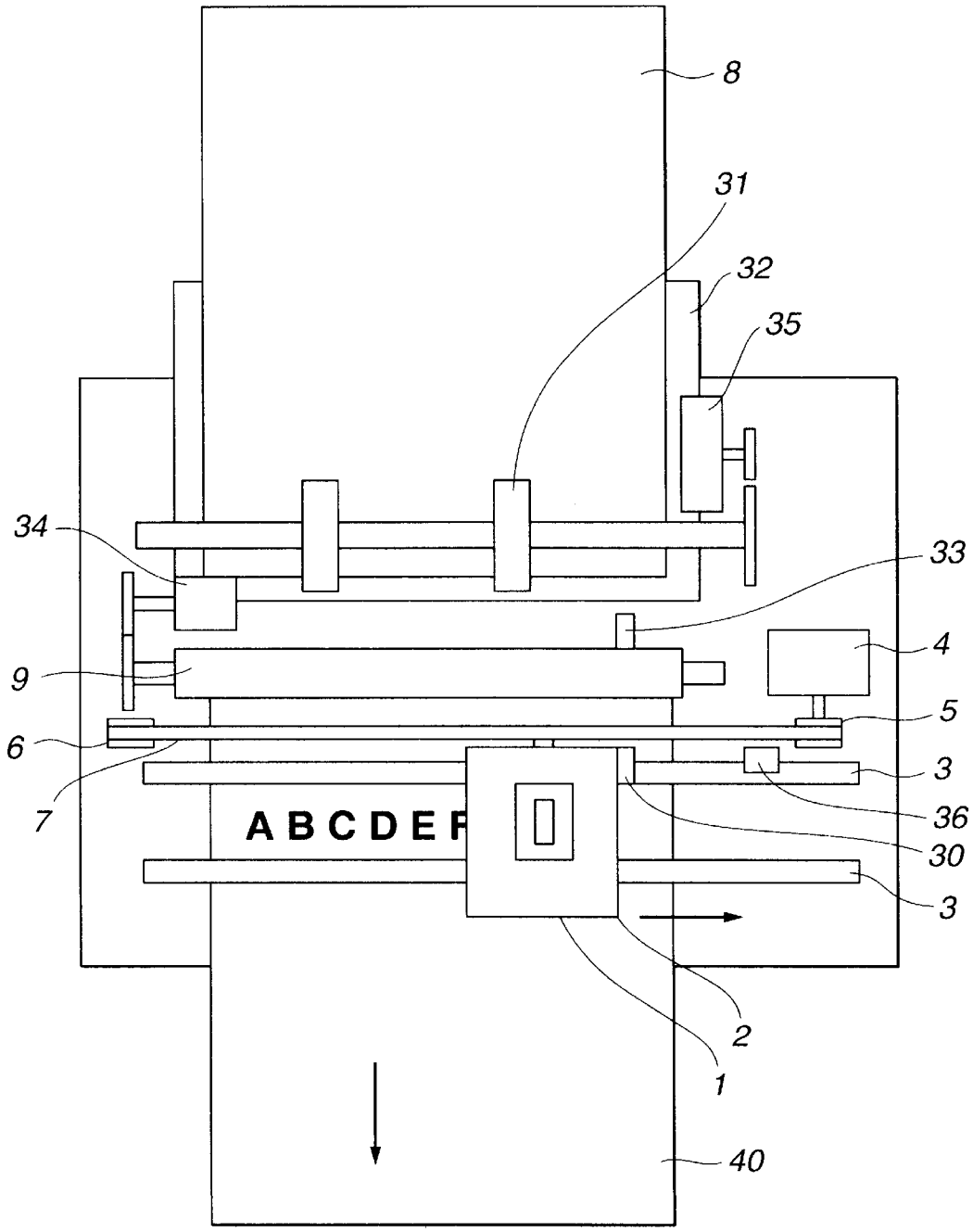
FIG. 7 is a diagram illustrating still another state immediately before starting sheet feeding.

A description will now be provided of the above-described case (3), in which feeding of the succeeding sheet is started while the preceding sheet is printed. FIG. 7 illustrates such a case.

In this state, the preceding sheet 40 is being printed. Precisely, the carriage 2 is driven in the main scanning direction by the main-scanning motor 4 and the head cartridge 1 is also driven, in order to perform printing on the preceding sheet 40.

The succeeding sheet 8 is stored in the ASF 32. Printing on the preceding sheet 40 is not completed, and the succeeding sheet 8 provides a second print. The operation will now be described with reference to the flowchart shown in FIG. 5. A printing command for the preceding sheet 40 has already been provided for the printing apparatus. Since an operation of feeding the preceding sheet 40 has already been completed, the flowchart shown in FIG. 5 has already been completed for the preceding sheet 40.

Then, in order to start printing on the succeeding sheet 8, feeding of the succeeding; sheet 8 is started. In the flowchart shown in FIG. 5, the sheet-feeding mode is started in step S10, as described above. In step S20, it is determined if the carriage 2 is operating. In this case, since printing is being performed, the carriage 2 is operating. Hence, the process proceeds to step S50, where it is determined if an operation for performing an operation in the sub-scanning direction is performed. In the case of FIG. 7, in order to move the preceding sheet 40 in the sub-scanning direction, the conveying roller 9 must be rotated. Hence, the process proceeds from step S50 to step S70.

In step S70, low-speed sheet feeding control is performed, and the sheet-feeding mode is terminated in step S90. In this case, since printing is being performed on the preceding sheet 40, high-speed sheet feeding is, in most cases, not required. In this case, sheet feeding may be started when the preceding sheet 40 has passed through the sheet-end sensor 33, or may be started at a timing such that continuous sheet feeding can be performed, by knowing in advance the length of the preceding sheet 40.

Table 1 illustrates the above-described combinations.

In Table 1, a word "HEAT" indicates ink discharge by driving the print head, and "CR", "LF" and "ASF" indicate that the carriage 2 is driven by the main-scanning motor 4, that the line-feeding motor 34 is driven, and that the automatic sheet feeder 32 is driven by the sheet feeding motor 35, respectively.

TABLE 1

| Combination | | | | | |
|---|---|---|---|---|---|
| 1 | 2 | 3 | 4 | 5 | 6 |
| CR | CR | CR | — | — | — |
| LF | — | — | LF | LF | — |
| — | HEAT | — | — | HEAT | — |
| ASF | ASF | ASF | ASF | ASF | ASF |
| In printing, and CR and LF are performing ramp up/down, or sheet feeding/discharging while moving CR to the start position | In printing, and sheet feeding in a state in which the head discharges ink while moving | Sheet feeding while CR moves to the start position | Sheet feeding/discharging | Sheet feeding/discharging while performing preliminary discharge | Sheet feeding |
| LSF | LSF | HSF | HSF | LSF | HSF |

Note:
LSF: low-speed feeding
HSF: high-speed feeding

The present invention provides excellent effects in a print head or a printing apparatus according to a method which includes means for generating thermal energy to be utilized for discharging ink (for example, electrothermal transducers, a laser beam or the like), and causes a change in the state of ink by the thermal energy, from among various types of ink-jet printing methods, because high-density and high-definition printing can be achieved according to such a method.

Typical configuration and principle of such a method are disclosed, for example, in U.S. Pat. Nos. 4,723,129 and 4,740,796. The disclosed method can be applied to both of so-called on-demand type and continuous type recording methods. Particularly, the on-demand type is effective because by applying at least one driving signal for causing a rapid temperature rise exceeding nucleate boiling to an electrothermal transducer disposed so as to face a sheet holding a liquid (ink), or a liquid channel in accordance with printing information, thermal energy is generated in the electrothermal transducer to cause film boiling on the heat operating surface of the print head and to form a bubble within the liquid (ink) corresponding to the driving signal. By discharging the liquid (ink) from the discharging opening due to the growth and contraction of the bubble, at least one droplet is formed. It is preferable to provide the driving signal in the form of a pulse because the bubble can be instantaneously and appropriately grown and contracted and the discharging of the liquid (ink) with a high response speed can be achieved. Pulse-shaped driving signals such as those described in U.S. Pat. Nos. 4,463,359 and 4,345,262 are suitable. By adopting conditions described in U.S. Pat. No. 4,313,124 relating to the rate of temperature rise of the heat operating surface, more excellent printing can be performed.

In addition to the configuration of combining discharging ports, a liquid channel and electrothermal transducers (a linear liquid channel or an orthogonal liquid channel) as disclosed in the above-described patent applications, configurations described in U.S. Pat. Nos. 4,558,333 and 4,459,600 in which a heat operating unit is disposed at a bending region may also be adopted for the print head of the present invention. In addition, the present invention is also effective for a configuration disclosed in Japanese Patent Application Laid-Open (Kokai) No. 59-123670 (1984) in which a common slit is used as a discharging port for a plurality of electrothermal transducers, and to a configuration disclosed in Japanese Patent Application Laid-Open (Kokai) No. 59-138461 (1984) in which an aperture for absorbing the pressure wave of thermal energy is used as a discharging port. That is, according to the: present invention, printing can be assuredly and efficiently performed irrespective of the form of the print head.

Furthermore, the present invention is also effective for serial-type heads as described above, for example, a print head fixed to the main body of the apparatus, an exchangeable chip-type print head capable of electric connection to the main body of the apparatus and ink supply from the main body of the apparatus by being mounted on the main body of the apparatus, and a cartridge-type print head having an ink tank provided as one body therewith.

The addition of means for recovering a discharging operation of the print head, preliminary auxiliary means and the like are preferable because the effects of the present invention can be more stabilized. More specifically, these means include capping means, cleaning means, and pressurizing or suctioning means for the print head, preliminary heating means for performing heating using an electrothermal transducer, a heating element other than the electrothermal transducer, or a combination of these elements, and preliminary discharging means for performing discharging other than printing.

As for the type or the number of print heads to be mounted, for example, a single head for monochromatic ink, or a plurality of heads for a plurality of ink liquids having different colors and density values may be used. That is, the present invention is very effective for a printing mode using a single color, such as black or the like, an integrally formed print head, a combination of a plurality of print heads, and a printing apparatus which has at least one of a printing mode using a plurality of different colors and a printing mode of obtaining a full-color image by mixing colors.

Although in the foregoing embodiment, a description has been provided illustrating ink in the form of a liquid, ink which is solidified at a temperature equal to or lower than the room temperature and is softened or liquified at the room temperature may also be used. In an ink-jet method, ink itself is generally subjected to temperature control within a range of 30° C.–70° C. so that the viscosity of the ink is within a range of stable discharge. Hence, ink which is liquified when providing a printing signal may also be used. Furthermore, in order to prevent temperature rise due to thermal energy by using the energy for liquifying ink from a solidified state or to prevent evaporation of ink, ink which is usually solid and is liquified by being heated may also be used. Anyway, the present invention can also be applied to a case in which ink is liquidized by providing thermal energy corresponding to a printing signal and the liquified ink is discharged, and to a case of using ink which is liquified by providing thermal energy and starts to be solidified when it reaches a printing medium. As disclosed in Japanese Patent Application Laid-Open (Kokai) Nos. 54-56847 (1979) and 60-71260 (1985), such ink may be provided so as to face an electrothermal transducer while being held in recesses or holes of a porous sheet in a liquid or solid state. In the present invention, the above-described film boiling method is most effective for the above-described ink.

The ink-jet printing apparatus of the present invention may be used as an image output terminal of an information processing apparatus, such as a computer or the like, a copier combined with a reader and the like, a facsimile apparatus having a transmission/reception function, and the like.

As described above, according to the present invention, an increase in electric power, which is a problem when driving a plurality of drivers using a plurality of corresponding driving sources in order to realize high-speed printing, can be prevented by driving the respective drivers by determining a state of concurrence of the driving sources and distributing electric power so as to minimize the total time. As a result, high-speed printing can be achieved with low electric power equivalent to conventionally used electric power.

Although in the foregoing embodiment, a description has been provided of an approach in which the states of use of electric power of all of a print head, a main scanning section for causing the print head to perform main scanning with respect to a printing medium, and an intermittent conveying section for intermittently conveying the printing medium in a sub-scanning direction, which serve as electric-power using sources other than a printing-medium feeding section, are determined, the present invention is not limited to such an approach. For example, electric power for driving the printing-medium feeding section may be controlled based on a result of determination of the state of use of electric power for at least one of the above-described electric-power using sources.

The individual components shown in outline or designated by blocks in the drawings are all well known in the printing apparatus arts and their specific construction and operation are not critical to the operation or the best mode for carrying out the invention.

While the present invention has been described with respect to what is presently considered to be the preferred embodiment, it is to be understood that the invention is not limited to the disclosed embodiment. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A printing apparatus for performing printing on a printing medium using a print head, comprising:

intermittent conveying means for intermittently conveying the printing medium to the print head in a sub-scanning direction, said intermittent conveying means being driven by electric power;

printing medium feeding means for feeding the printing medium to said intermittent conveying means before performing printing, said printing medium feeding means being driven by electric power;

electric-power control means for controlling electric power for driving said printing medium feeding means; and determination means for determining a state of use of electric power of at least one of (i) said intermittent conveying means and (ii) at least one other electric-power using source other than said printing medium feeding means, when driving said printing medium feeding means, wherein said electric-power control means controls electric power for driving said printing medium feeding means, based on a result of determination of said determination means, to determine a feeding speed by said printing medium feeding means.

2. A printing apparatus according to claim 1, wherein, when said determination means has determined that the state of use of electric power exceeds a predetermined state of use, said electric-power control means controls a feeding speed by said printing medium feeding means to be a first speed, and wherein, when said determination means has determined that the state of use of electric power is within the predetermined state of use, said electric-power control means controls the feeding speed by said printing medium feeding means to be a second speed higher than the first speed.

3. A printing apparatus according to claim 2, wherein said at least one other electric-power using source comprise said print head and main-scanning means for causing said print head to perform relative main scanning with respect to the printing medium, and wherein, when only said main-scanning means and said intermittent conveying means from among said electric-power using sources are driven when driving said printing medium feeding means, said determination means determines that the state of use of electric power of said electric-power using sources exceeds the predetermined state of use.

4. A printing apparatus according to claim 2, wherein said at least one other electric-power using source comprise said print head and main-scanning means for causing said print head to perform relative main scanning with respect to the printing medium, and wherein, when only said print head and said main-scanning means from among said electric-power using sources are driven when driving said printing medium feeding means, said determination means determines that the state of use of electric power of said electric-power using sources exceeds the predetermined state of use.

5. A printing apparatus according to claim 2, wherein said at least one other electric-power using source comprise said print head and main-scanning means for causing said print head to perform relative main scanning with respect to the printing medium, and wherein, when only said main-scanning means from among said electric-power using sources is driven when driving said printing medium feeding means, said determination means determines that the state of use of electric power of said electric-power using sources does not exceed the predetermined state of use.

6. A printing apparatus according to claim 2, wherein said at least one other electric-power using source comprise said print head and main-scanning means for causing said print head to perform relative main scanning with respect to the printing medium, and wherein, when only said intermittent conveying means from among said electric-power using sources is driven when driving said printing medium feeding means, said determination means determines that the state of use of electric power of said electric-power using sources does not exceed the predetermined state of use.

7. A printing apparatus according to claim 2, wherein said at least one other electric-power using source comprise said print head and main-scanning means for causing said print head to perform relative main scanning with respect to the printing medium, and wherein, when only said intermittent conveying means and said print head from among said electric-power using sources are driven when driving said printing medium feeding means, said determination means determines that the state of use of electric power of said electric-power using sources exceeds the predetermined state of use.

8. A printing apparatus according to claim 2, wherein said at least one other electric-power using source comprise said print head and main-scanning means for causing said print head to perform relative main scanning with respect to the printing medium, and wherein, when none of said print head, said main-scanning means and said intermittent conveying means from among said electric-power using sources are driven when driving said printing medium feeding means, said determination means determines that the state of use of electric power of said electric-power using sources does not exceed the predetermined state of use.

9. A printing apparatus according to claim 2, wherein the predetermined state of use is a predetermined power level.

10. A printing apparatus according to claim 1, wherein said at least one other electric-power using source is at least one of said print head and main-scanning means for causing said print head to perform relative main scanning with respect to the printing medium.

11. A printing apparatus according to claim 10, wherein, when at least one of said at least one other electric-power using source and said intermittent conveying means is driven when driving said printing-medium feeding means, said determination means determines that the state of use of electric power exceeds the predetermined state of use.

12. A printing apparatus according to claim 1, wherein said print head is an ink-jet head, which comprises thermal-energy generation means for discharging ink by causing film boiling within ink.

13. A printing apparatus according to claim 1, wherein said printing medium feeding means comprises an automatic sheet feeder.

14. A method for controlling electric power in a printing apparatus for performing printing on a printing medium using a print head, said method comprising:

an intermittent conveying step for intermittently conveying the printing medium to the print head in a sub-scanning direction;

a printing medium feeding step utilizing a printing medium feeding unit driven by electric power for feeding the printing medium to be intermittently conveyed before performing printing; and a determination step for determining a state of use of electric power by components other than the printing medium feeding unit when executing said printing medium feeding step, the other components being executable simultaneously with said printing medium feeding step, wherein a magnitude of electric power used by the printing medium feeding unit in said printing medium feeding step is controlled in accordance with a result of the determination in said determination step.

15. A printing apparatus for performing printing on a printing medium using a print head, comprising:

an intermittent conveying unit to intermittently convey the printing medium to the print head in a sub-scanning direction, said intermittent conveying unit being driven by electric power;

a printing medium feeding unit that feeds the printing medium to said intermittent conveying unit before performing printing, said printing medium feeding unit being driven by electrical power; and a controller that controls the electric power for driving said printing medium feeding unit, said controller determining a state of use of electric power of at least one of (i) said intermittent conveying unit and (ii) at least one other electric-power using source other than said printing medium feeding unit, when driving said printing medium feeding unit, wherein said controller controls electric power for driving said printing medium feeding unit, based on a result of determination regarding the state of use of electric power, to determine a feeding speed by said printing medium feeding unit.

16. A printing apparatus according to claim 15, wherein said at least one other electric-power using source is at least one of said print head and a main-scanning carriage unit that scans said print head with respect to the printing medium in a main scanning direction.

17. A printing apparatus according to claim 16, wherein, when at least one of said at least one other electric-power using source and said intermittent conveying unit is driven when driving said printing medium feeding unit, said controller determines that the state of use of electric power exceeds the predetermined state of use.

18. A printing apparatus according to claim 15, wherein, when said controller has determined that the state of use of electric power exceeds a predetermined state of use, said controller controls a feeding speed by said printing medium feeding unit to be a first speed, and when said controller has determined that the state of use of electric power is within the predetermined state of use, said controller controls the feeding speed by said printing medium feeding unit to be a second speed higher than the first speed.

19. A printing apparatus according to claim 18, wherein said at least one other electric-power using source comprise said print head and a main-scanning carriage that scans said print head with respect to the printing medium in a main scanning direction, and wherein, when only said main-scanning carriage and said intermittent conveying unit from among said electric-power using sources are driven when driving said printing medium feeding unit, said controller determines that the state of use of electric power of said electric-power using sources exceeds the predetermined state of use.

20. A printing apparatus according to claim 18, wherein said at least one other electric-power using source comprise said print head and a main-scanning carriage unit that scans said print head with respect to the printing medium in a main scanning direction, and wherein, when only said print head and said main-scanning carriage from among said electric-power using sources are driven when driving said printing medium feeding unit, said controller determines that the state of use of electric power of said electric-power using sources exceeds the predetermined state of use.

21. A printing apparatus according to claim 18, wherein said at least one other electric-power using source comprise said print head and a main-scanning carriage that scans said print head with respect to the printing medium in a main scanning direction, and wherein, when only said main-scanning carriage from among said electric-power using sources is driven when driving said printing medium feeding unit, said controller determines that the state of use of electric power of said electric-power using sources does not exceed the predetermined state of use.

22. A printing apparatus according to claim 18, wherein said at least one other electric-power using source comprise said print head and a main-scanning carriage that scans said print head with respect to the printing medium in a main scanning direction, and wherein, when only said intermittent conveying unit from among said electric-power using sources is driven when driving said printing medium feeding unit, said controller determines that the state of use of electric power of said electric-power using sources does not exceed the predetermined state of use.

23. A printing apparatus according to claim 18, wherein said at least one other electric-power using source comprise said print head and a main-scanning carriage that scans said print head with respect to the printing medium in a main scanning direction, and wherein, when only said intermittent conveying unit and said print head from among said electric-power using sources are driven when driving said printing medium feeding unit, said controller determines that the state of use of electric power of said electric-power using sources exceeds the predetermined state of use.

24. A printing apparatus according to claim 18, wherein said at least one other electric-power using source comprise said print head and a main-scanning carriage unit that scans said print head with respect to the printing medium in a main scanning direction, and wherein, when none of said print head, said main-scanning carriage and said intermittent conveying unit from among said electric-power using sources are driven when driving said printing medium feeding unit, said controller determines that the state of use of electric power of said electric-power using sources does not exceed the predetermined state of use.

25. A printing apparatus according to claim 15, wherein said print head is an ink jet head, which comprises thermal-energy generators for discharging ink by causing film boiling within the ink.

26. A printing apparatus according to claim 15, wherein the predetermined state of use is a predetermined power level.

27. A printing apparatus according to claim 15, wherein said printing medium feeding unit comprises an automatic sheet feeder.

* * * * *

UNITED STATES PATENT AND TRADEMARK OFFICE

CERTIFICATE OF CORRECTION

PATENT NO. : 6,497,468 B1
DATED : December 24, 2002
INVENTOR(S) : Otsuka

It is certified that error appears in the above-identified patent and that said Letters Patent is hereby corrected as shown below:

Column 2,
Line 53, ".the" should read -- the --; and
Line 57, "illustrating the," should read -- illustrating the --.

Column 3,
Line 55, "feeding," should read -- feeding --.

Column 5,
Line 52, "ink" should read -- ink- --.

Column 6,
Line 58, "is." should read -- is --.

Column 8,
Line 40, "succeeding;" should read -- succeeding --.

Column 10,
Line 6, "the:" should read -- the --.

Column 16,
Line 4, "ink jet" should read -- ink-jet --.

Signed and Sealed this

Twenty-first Day of October, 2003

JAMES E. ROGAN
*Director of the United States Patent and Trademark Office*